US009100766B2

(12) United States Patent
Soulodre

(10) Patent No.: US 9,100,766 B2
(45) Date of Patent: Aug. 4, 2015

(54) MULTICHANNEL AUDIO SYSTEM HAVING AUDIO CHANNEL COMPENSATION

(75) Inventor: Gilbert Arthur Joseph Soulodre, Kanata (CA)

(73) Assignee: Harman International Industries, Inc., Northridge, CA (US)

( * ) Notice: Subject to any disclaimer, the term of this patent is extended or adjusted under 35 U.S.C. 154(b) by 396 days.

(21) Appl. No.: 12/897,707

(22) Filed: Oct. 4, 2010

(65) Prior Publication Data

US 2011/0081032 A1 Apr. 7, 2011

Related U.S. Application Data

(60) Provisional application No. 61/248,760, filed on Oct. 5, 2009.

(51) Int. Cl.
*H04R 5/02* (2006.01)
*H04S 1/00* (2006.01)
(Continued)

(52) U.S. Cl.
CPC ..... *H04S 1/002* (2013.01); *H04S 3/002* (2013.01); *H04R 2499/13* (2013.01); *H04S 7/305* (2013.01); *H04S 2400/11* (2013.01)

(58) Field of Classification Search
USPC ..... 381/300, 302, 303, 86, 310
See application file for complete search history.

(56) References Cited

U.S. PATENT DOCUMENTS 4,218,585 A * 8/1980 Carver ..... 381/303
5,046,097 A 9/1991 Lowe et al. ..... 381/17
(Continued)

FOREIGN PATENT DOCUMENTS

EP 0 329 201 A2 8/1989
EP 0164973 B1 8/1990
(Continued)

OTHER PUBLICATIONS

International Search Report and Written Opinion, mailed Jun. 8, 2011 in PCT/US2010/051371, filed Oct. 4, 2010 (14 pgs.).
(Continued)

*Primary Examiner* — Duc Nguyen
*Assistant Examiner* — Taunya McCarty
(74) *Attorney, Agent, or Firm* — Brooks Kushman, P.C.

(57) ABSTRACT

A multichannel compensating audio system includes first and second compensation channels to psychoacoustically minimize deviations in a target response, to psychoacoustically move the physical position of a speaker and/or to psychoacoustically provide a substantially equal magnitude of sound from a plurality of speakers in a plurality of different listening positions. The first compensation channel may include a series connected delay circuit, a level adjuster circuit and a frequency equalizer circuit that generates a first compensated audio signal from a first audio signal. The second compensation channel may include a series connected delay circuit, a level adjuster circuit and a frequency equalizer circuit that generates a second compensated audio signal from a second audio signal. A first summing circuit is configured to receive at least the first audio signal and the second compensated audio signal and generate a first output signal for provision to a first speaker. A second summing circuit is configured to receive the second audio signal and the first compensated audio signal and generate a second output signal for provision to a second speaker. The first and second output signals may be output by the first and second speakers into a listening space and are acoustically perceived by a listener.

27 Claims, 9 Drawing Sheets

(51) Int. Cl.
*H04S 3/00* (2006.01)
*H04S 7/00* (2006.01)

(56) References Cited

U.S. PATENT DOCUMENTS

| | | | | |
|---|---|---|---|---|
| 5,105,462 | A | 4/1992 | Lowe et al. | 381/17 |
| 5,136,651 | A | 8/1992 | Cooper et al. | |
| 5,208,860 | A | 5/1993 | Lowe et al. | 381/17 |
| 5,369,710 | A | 11/1994 | Asai | |
| 5,530,760 | A | 6/1996 | Paisley | 381/27 |
| 5,594,800 | A | 1/1997 | Gerzon | 381/20 |
| 5,809,150 | A | 9/1998 | Eberbach | 381/24 |
| 5,850,455 | A | 12/1998 | Arnold et al. | 381/17 |
| 5,862,227 | A | 1/1999 | Orduña-Bustamante et al. | 381/17 |
| 5,889,867 | A | 3/1999 | Bauck | 381/1 |
| 5,912,975 | A | 6/1999 | Schott | 381/1 |
| 5,912,976 | A | 6/1999 | Klayman et al. | 381/18 |
| 5,949,894 | A | 9/1999 | Nelson et al. | 381/300 |
| 5,974,153 | A | 10/1999 | Cashion et al. | 381/11 |
| 6,122,381 | A | 9/2000 | Winterer | 381/17 |
| 6,173,061 | B1 | 1/2001 | Norris et al. | 381/309 |
| 6,175,489 | B1 | 1/2001 | Markow et al. | 361/683 |
| 6,175,631 | B1 | 1/2001 | Davis et al. | 381/17 |
| 6,222,930 | B1 | 4/2001 | Nakano et al. | 381/307 |
| 6,229,899 | B1 | 5/2001 | Norris et al. | 381/77 |
| 6,236,730 | B1 | 5/2001 | Cowieson et al. | 381/18 |
| 6,259,795 | B1 | 7/2001 | McGrath | 381/310 |
| 6,307,941 | B1 | 10/2001 | Tanner, Jr. et al. | 381/17 |
| 6,430,535 | B1 | 8/2002 | Spille et al. | 704/500 |
| 6,498,857 | B1 | 12/2002 | Sibbald | 381/310 |
| 6,504,934 | B1 | 1/2003 | Kasai et al. | 381/17 |
| 6,574,339 | B1 | 6/2003 | Kim et al. | 381/17 |
| 6,577,736 | B1 | 6/2003 | Clemow | 381/18 |
| 6,577,738 | B2 | 6/2003 | Norris et al. | 381/77 |
| 6,611,603 | B1 | 8/2003 | Norris et al. | 381/309 |
| 6,687,378 | B1 * | 2/2004 | Nakamura | 381/86 |
| 6,694,033 | B1 | 2/2004 | Rimell et al. | 381/307 |
| 6,714,652 | B1 | 3/2004 | Davis et al. | 381/17 |
| 6,741,706 | B1 | 5/2004 | McGrath et al. | 381/22 |
| 6,766,028 | B1 | 7/2004 | Dickens | 381/310 |
| 6,801,627 | B1 | 10/2004 | Kobayashi | 381/17 |
| 6,804,565 | B2 | 10/2004 | Eid | 700/94 |
| 6,853,732 | B2 | 2/2005 | Scofield | 381/27 |
| 7,298,853 | B2 * | 11/2007 | Norris et al. | 381/77 |
| 7,447,321 | B2 | 11/2008 | Furge et al. | 381/186 |
| 7,653,203 | B2 * | 1/2010 | Holmi et al. | 381/86 |
| 2003/0039366 | A1 | 2/2003 | Eid et al. | 381/27 |
| 2003/0147543 | A1 | 8/2003 | Katayama et al. | 381/309 |
| 2004/0131338 | A1 * | 7/2004 | Asada et al. | 386/96 |
| 2004/0136553 | A1 | 7/2004 | Lee et al. | 381/307 |
| 2004/0234076 | A1 | 11/2004 | Agostini | 381/18 |
| 2004/0247140 | A1 | 12/2004 | Norris et al. | |
| 2004/0247144 | A1 | 12/2004 | Nelson et al. | 381/300 |
| 2005/0047618 | A1 | 3/2005 | Davis et al. | 381/309 |
| 2005/0271223 | A1 * | 12/2005 | Itabashi et al. | 381/98 |
| 2009/0086982 | A1 * | 4/2009 | Kulkarni et al. | 381/1 |
| 2011/0010269 | A1 * | 1/2011 | Ballard | 705/26.41 |

FOREIGN PATENT DOCUMENTS

| | | |
|---|---|---|
| JP | 60-254995 | 12/1985 |
| JP | 03-148905 | 6/1991 |
| JP | 2003-116200 | 4/2003 |

OTHER PUBLICATIONS

Japanese Office Action, mailed Jun. 12, 2013 in Japanese Application No. 2012-532144, (11 pgs.).

Korean Office Action, mailed Jul. 24, 2013, in Korean Application No. 10-2012-7008791 (6 pgs.).

Office Action dated Jan. 29, 2014, for corresponding Canadian Application 2,773,812 filed Mar. 9, 2012.

Canadian Office Action Dated Mar. 13, 2015 for corresponding CA application CA2773812.

* cited by examiner

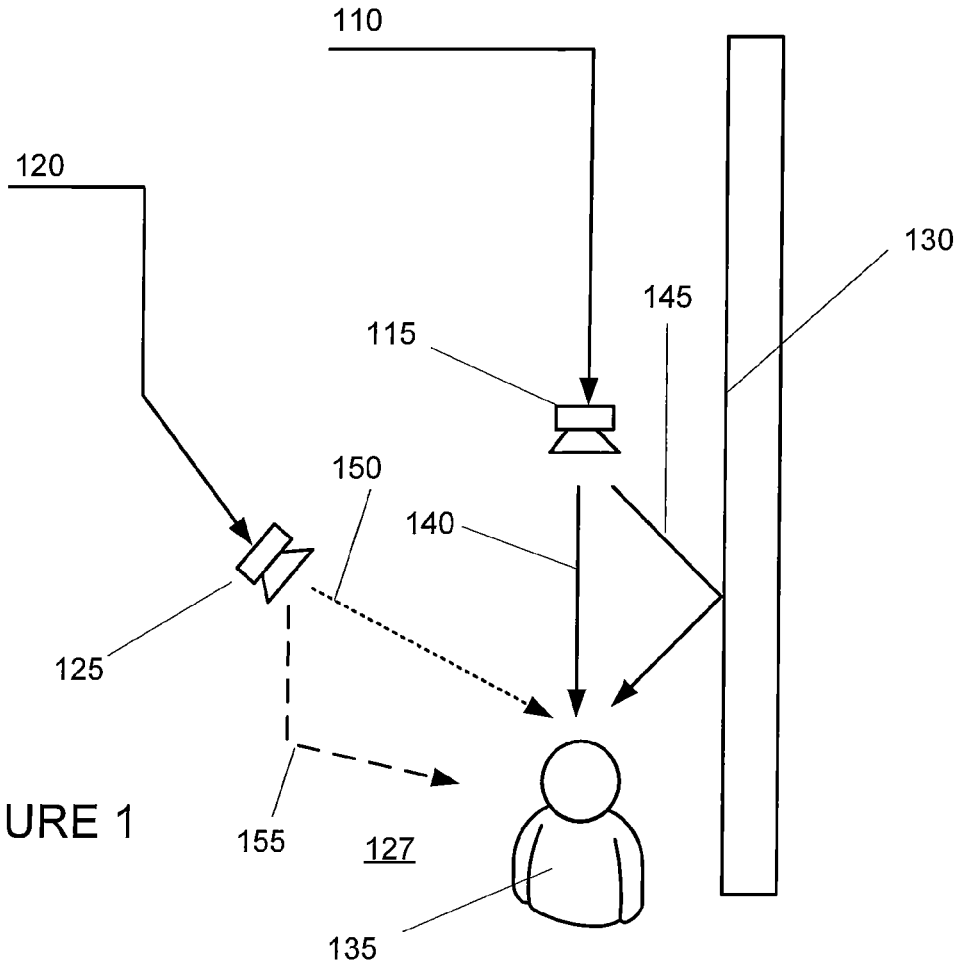
FIGURE 1
FIGURE 2
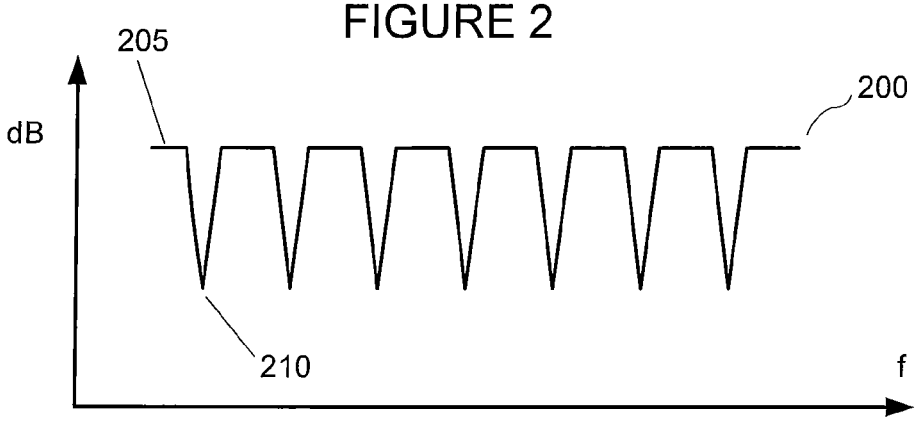

MULTICHANNEL AUDIO SYSTEM HAVING AUDIO CHANNEL COMPENSATION

PRIORITY CLAIM

This application claims the benefit of priority from U.S. Provisional Application No. 61/248,760, filed Oct. 5, 2009, which is incorporated by reference.

BACKGROUND OF THE INVENTION

1. Technical Field

The present invention relates to multichannel audio systems and, more particularly, to an audio channel compensation system for a multichannel audio system.

2. Related Art

The perception of sound provided by an audio system in an environment may be degraded by reflective surfaces in that environment. A listener in such an environment is presented with both the original sound and a delayed version of the sound, which results in constructive and destructive interference. This type of interference can produce deviations, such as a comb filtering effect, in a target frequency response. The frequency response of a comb filter includes a series of regularly-spaced peaks and troughs, giving the appearance of a comb. The listener therefore receives a sound having a different frequency response than the intended sound originally emitted by the sound system.

Deviations in the target frequency response, such as comb filtering, may be particularly noticeable in substantially enclosed environments, such as the passenger cabin of a vehicle having a multichannel audio sound system. Each listener in the cabin receives both direct and reflected sound associated with each channel, resulting in deviations such as complex comb filtering interactions that reduce enjoyment of the listening experience.

SUMMARY

A multichannel compensating audio system may correct deviations in a target response at one or more listening positions within a listening area using one or more compensation channels. Each of the one or more compensation channels may include a series connected delay circuit, a level adjuster circuit and frequency equalizer circuit that generates a compensated audio signal from an audio signal on a channel of an input audio signal.

The multichannel compensating audio system may drive a plurality of loudspeakers with corresponding audio signals provided from a sound source as a multichannel audio input signal. For example, a 5.1 channel input audio signal may drive Center, Right Front, Left Front, Right Rear and Left Rear speakers with corresponding audio signals provided on center, right front, left front, right rear, and left rear audio channels. Each of the one or more compensation channels may receive and process audio signal to generate a compensated audio signal.

In the case of a first channel and a second channel, and a corresponding first speaker and a second speaker, a listener in a listening location may psychoacoustically perceive deviations in a target frequency response due to output by the first speaker of the audio signal on the first channel. In this case, a compensation channel may generate a compensated audio signal from a first audio signal being supplied to the first speaker on the first channel based on a predetermined delay, a predetermined energy level adjustment and/or a predetermined equalization (EQ). The compensated audio signal may be electronically summed with a second audio signal being supplied to the second speaker on the second channel. When the first and second speakers operate in a listening space, the first audio signal output from the first speaker may be heard at the listening location in the listening space, and the listener at the listening location may perceptually localize the origination of the first audio signal as being from the first loudspeaker. When the summation of the compensated audio signal and the second audio signal are output from the second speaker, the listener may psychoacoustically perceive corrections to the deviations in the target response due to the first speaker. However, due to the multichannel compensating audio system, the listener in the listening position may not psychoacoustically perceive a change in the location of origin of the first audio signal.

Another interesting feature of the multichannel compensating audio system may involve equalizing the loudness of sound emitted from different loudspeakers as psychoacoustically perceived at a number of different listening locations in a listening space. Using the audio channels and compensated audio signals that are selectively produced from different speakers, the listeners at different listening locations may psychoacoustically perceive a substantially uniform level of spectral energy being produced by the speakers. Still another interesting feature involves movement of a listener perceived location of a source of audible sound using the audio signals and the compensated audio signals.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 1 is an example multichannel compensating audio system.

FIG. 2 is a frequency response of a comb filter that may be associated with sound emitted from a speaker of the system of FIG. 1.

DETAILED DESCRIPTION OF THE PREFERRED EMBODIMENTS

Figure 3:
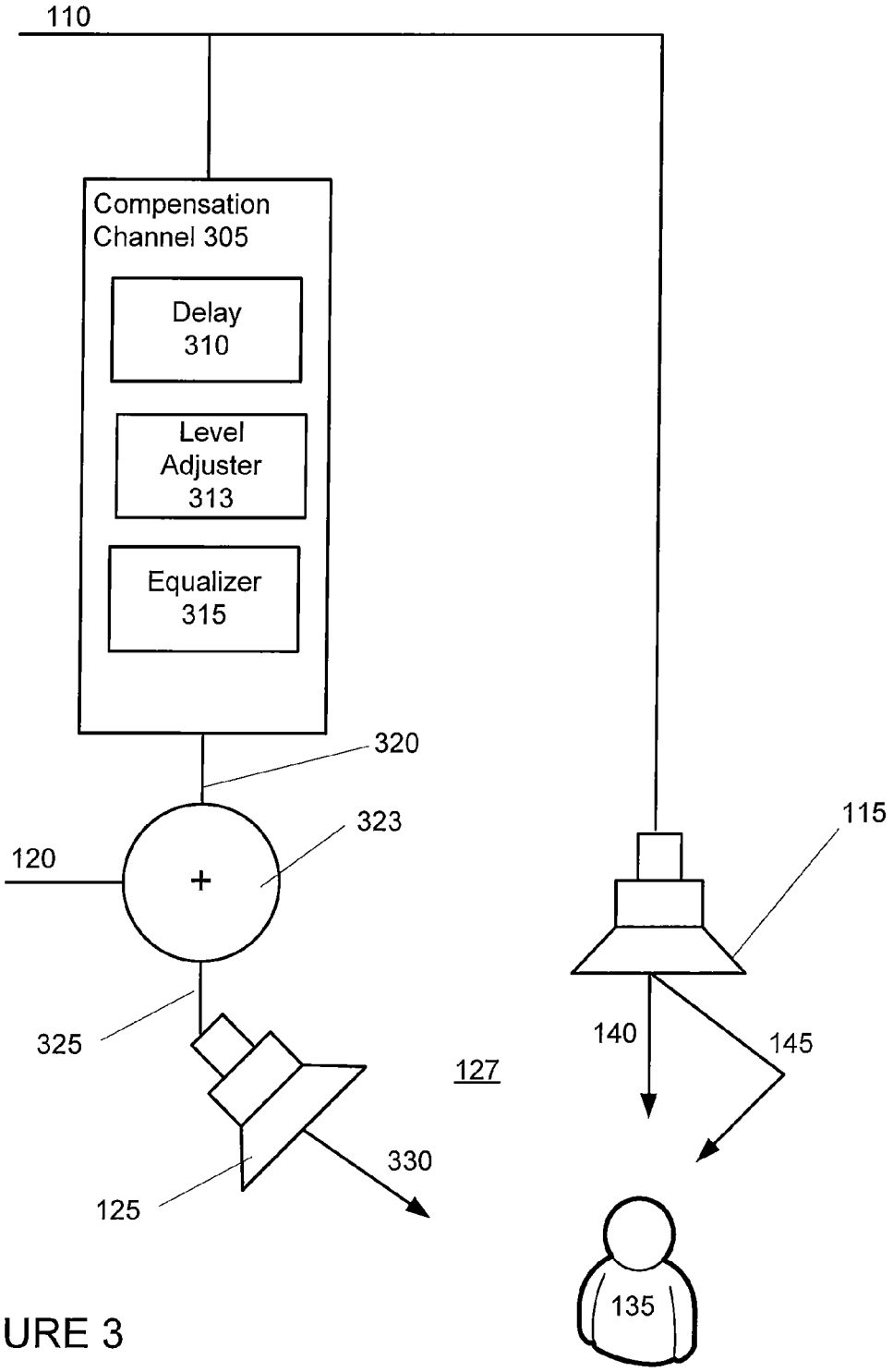
FIG. 3 is a multichannel compensating audio system having channel compensation associated with a single channel of the system.

Deviations in a target frequency response at one or more listening positions within a listening space, such as passenger locations in a vehicle, may be at least partially addressed with selective frequency equalization of the audio signal. For example, a comb filtering effect associated with a channel may be at least partially addressed by providing equalization to the affected channel. Such equalization may involve providing frequency boosts and/or frequency reductions directly to the channel to correct for the dips and peaks representative of deviations in the target frequency response. Although deviations in the target frequency response for a given channel may depend on the location of a listener within the listening space or listening environment, a general frequency equalization setting may be provided on the channel based on the common areas in which the listener is positioned within the listening space or listening environment.

Application of equalization directly to an affected channel, may not provide satisfactory compensation for deviations in a target frequency response at one or more listening positions due to the equalized signal emitted by the channel still being subject to reflection. A listener positioned in a location within the listening space may receive both the equalized signal emitted by the channel and a delayed version of the equalized signal from the reflective surfaces. Thus, equalization can, for example, merely result in a change in the frequency response of a comb filter that does not adequately compensate for the degradation of the sound emitted from the channel.

With some multichannel audio sound systems the corresponding listening environments may have a limited amount of space. One such environment is the passenger cabin of a vehicle. When space in the listening environment is limited, the quality and placement of the speakers within the cabin may likewise be limited. For example, a speaker for an audio channel may necessarily be located at a less than optimal position within a vehicle cabin due to the design constraints imposed by the overall design of the cabin. Further, speakers having different speaker qualities with respect to one another may be used based on cost constraints, available space for a speaker, and other criterion. Such variations in quality and placement of speakers in a listening environment may also contribute to deviations from a target frequency response at the listening positions unless appropriate channel compensation is applied.

FIG. 1 is an example multichannel compensating audio system that may employ channel compensation. Two channels of the multichannel compensating audio system are shown in FIG. 1, although more channels may be employed. The multichannel compensating audio system of FIG. 1 is shown without channel compensation enabled. As used herein, the term "multichannel" describes two or more audio channels provided within an input audio signal to drive two or more loudspeakers. Example multichannel audio signals include a stereo audio signal, a 5.1 channel audio signal, a 6.1 channel audio signal, a 7.1 audio signal, or any other audio signal that includes two or more audio channels.

The multichannel compensating audio system may include one or more processors such as a digital signal processor and memory. Operation of the multichannel compensating audio system may be based on instructions, software or code stored in the memory that are executable by the processor, electronic hardware, and devices and systems controlled by the processor, or some combination. The memory can include volatile, non-volatile, flash, magnetic, or any other form of non-transient memory capable of storing the executable instructions, information/parameters of the audio system, user specific configuration information, and data such as audio content, audio-visual content, or any other information capable of being stored and accessed. The multichannel compensating audio system may also include a user interface, capable of receiving user inputs and providing information to a user of the system. In addition, the multichannel compensating audio system may include amplifiers, audio sources, and wired or wireless interfaces to external devices, as well as functionality such as navigation, telecommunications, satellite communications, desktop computing, and any other functions or capabilities.

The multichannel compensating audio system may include a first audio signal 110 provided without compensation to a first speaker 115. A second audio signal 120 may be provided to a second speaker 125 without compensation. The first and second audio signals 110 and 120 may represent audio content present on different audio channels within an input audio signal of the multichannel audio system, such as a stereo, 5.1, 6.1, or 7.1 audio channels. Sound emitted from each speaker 115 and 125 is dispersed in a complex manner in a listening environment 127 and may involve multiple interactions between the reflective surfaces within the listening environment 127, the direct 140 and reflected 145 sound from speaker 115, and the direct 150 and reflected 155 sound from the second speaker 125.

For simplicity, only a very basic interaction of the sound emitted from speaker 115 in the listening environment 127 is illustrated. In this simplified representation, a listener positioned in a listening location 135 within the listening environment 127 receives the direct sound 140 from speaker 115 and sound 145 from speaker 115 that is reflected from reflective surface 130. As such, a listener at the listening position 135 in the listening environment 127 is presented with both the direct sound 140 and a delayed version of the sound 145, which can result in constructive and destructive interference that may produce deviations in a target frequency response, such as a comb filtering effect. In other examples, more loudspeakers, more listening positions, and more reflective surfaces may be present.

An exemplary comb filtering response representative of a deviation in a target frequency response is shown in FIG. 2. As shown, the frequency response 200 of the comb filter includes a series of regularly-spaced peaks 205 and troughs 210, giving the appearance of a comb. The listener at the listening location 135 receives a sound having a different frequency response than the original sound emitted by the speaker 115. As used herein, deviations in a target frequency response refers to audible sound received by a listener at a listening position within a listening space that does not come within a desired range of frequency response. Comb filtering is but one example describing deviation from a target frequency response, but as discussed herein should be considered a non-limiting example representative and interchangeable with other forms of deviations from a target frequency response psychoacoustically perceived by a listener at a listening position in a listening space. As used herein, the terms "psychoacoustically perceived" or "perceived" or "perception" or "psychoacoustical perception" refers to a listener's awareness, observation, and discernment of a sound field being experienced by the listener within a listening area or listening space.

FIG. 3 shows another example of the multichannel compensating audio system of FIG. 1 with compensation for a single channel. In FIG. 3, the first audio signal 110 is provided to speaker 115 as audio content of a single channel in the input audio signal. As in FIG. 1, a listener at the listening position 135 in the listening space 127 receives both a direct sound 140 and reflected sound 145 from speaker 115 being driven by the first audio signal 110. To compensate for the direct and indirect sounds occurring in listening environment 127, audio signal 110 is also provided to the input of a compensation channel 305.

Compensation channel 305 may include a series connected delay circuit 310, a level adjuster circuit 313, and an equalizer circuit 315 through which the audio signal 110 is processed. The delay circuit 310, the level adjuster circuit 313, and the equalizer circuit 315, may be modules consisting of instructions stored in memory and executable by a processor, hardware such as electronic circuits, registers, and electrical circuit devices, or come combination of instructions and hardware. The delay circuit 310 may be used to selectively add delay to the frequencies or different ranges of frequencies included in the audio signal 110. As described later, the delay may be used to preserve a physical direction or location of sound being produced in a listening space. The level adjuster circuit 313 may be used to globally adjust the spectral energy of the audio signal to increase or attenuate the energy level of the audio content across the entire range of frequencies represented in the audio signal 110. As described later, the adjustment of the energy level of an audio signal may decrease or increase the overall magnitude of audible sound output by a speaker. The equalization circuit 315 may be used to selectively increase and attenuate the energy level of individual frequencies or different ranges of frequencies included in the audio signal 110. In some examples, the equalization circuit 315 may also perform global adjustment of the audio signal, and the level adjuster circuit 313 may be omitted.

The output of the compensation channel 305 constitutes a compensated audio signal 320. The compensated audio signal 320 is provided to the input of a summing circuit 323 along with the second audio signal 120, which is representative of audio content of another single channel included in the input audio signal. The summing circuit 323 adds and/or subtracts the second audio signal 120 and compensated audio signal 320 with respect to one another to generate an output signal 325 that is provided to speaker 125. Speaker 125 emits sound 330 into the listening environment 127 that corresponds to a combination of both the second audio signal 120 and the compensated version 320 of the first audio signal 110. As used herein, the term "signal" or "signals" is used interchangeably to describe either electrical signals, or audible sounds produced by mechanical operation of a respective speaker based on corresponding electrical signals.

In the multichannel audio system of FIG. 3, the amount of delay provided by delay circuit 310, level adjustment provided by the level adjuster 313, and equalization provided by equalizer circuit 315 may be selected to reduce the comb filtering effect shown in FIG. 2, while still maintaining a psychoacoustical perception by the listener 135 that the source of audible sound representative of the audio content in the single channel is the first speaker 115 or in the vicinity and/or coming from the direction where the first speaker 115 is physically located.

Figure 4:
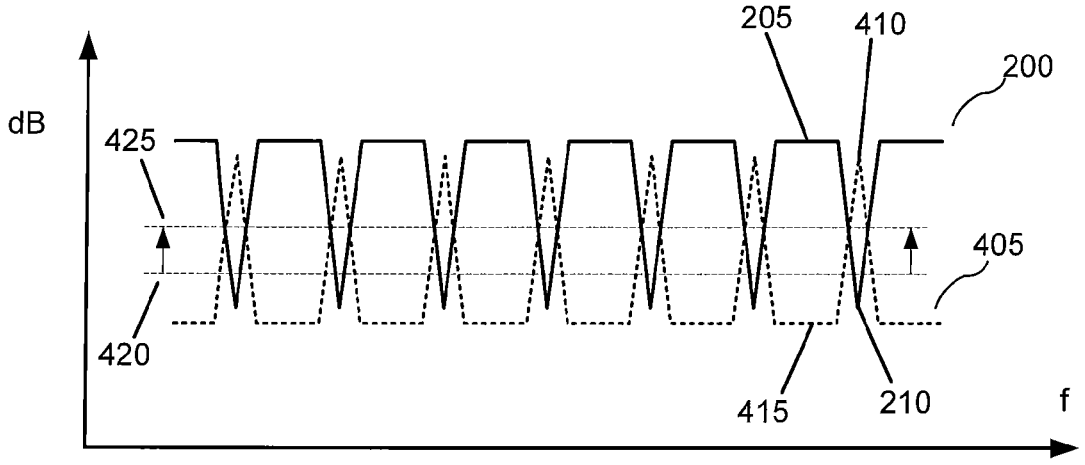
FIG. 4 is the frequency response of the comb filter shown in FIG. 2 as well as the compensated frequency response generated through use of the channel compensation shown in FIG. 3.

An example of the resulting frequency response of the compensated sound in the listening environment 127 is shown in FIG. 4. Response 200 corresponds to the un-compensated response for the system shown in FIG. 1. The frequency response of the compensated audio signal 325 as represented with the sound 330 emitted by speaker 125 is shown at 405. Frequency response 405 includes peaks 410 occurring at the troughs 210 of frequency response 200. Thus, frequency response 405 is constructively added to the frequency response 200. Response 405 also includes troughs 415 occurring at peaks 205 of frequency response 200. Frequency response 405 is not performing cancellation of any portion of frequency response 200. Accordingly, exact alignment in phase of frequency response 405 and frequency response 200 is unnecessary. In addition, the range of frequencies in the frequency response 405 and the range of frequencies in the frequency response 200 may be overlapping to enable the filling of multiple troughs 210 by the peaks 410. As such, equalization of the frequency response 405 may occur in frequencies or ranges of frequency that are also present in frequency response 200.

Also illustrated in FIG. 4, is a first average energy level 420 of the compensated audio signal 325, which is shown as increased by a determined amount with the level shifter circuit 313 to a second average energy level 425. The compensated audio signal 325 may be increased (or decreased) so that the magnitude of the peaks 410 of the frequency response 405 are more closely aligned with respect to the magnitude of the peaks 205 of the frequency response 200. As a result, the frequency response 405 can be maintained at or below a level of magnitude of the frequency response 200 to avoid being psychoacoustically detected (or psychoacoustically perceived) by a listener as being emitted from a different physical location from frequency response 200, or causing the perceived location of frequency response 200 to shift in physical location.

When frequency responses 200 and 405 combine with one another in the listening environments 127, the listener perceived comb filtering effect associated with sound emitted from speaker 115 may be substantially reduced. In one example, the compensation channel 305 delays, energy adjusts, and equalizes the first audio signal so that sound corresponding to the first audio signal is received by a listener in the listening environment with minimized combing effect, and is psychoacoustically perceived by the listener as being produced from the first speaker 115.

Referring again to FIG. 3, an input signal 110 may drive the first speaker 115 to emit audible sound that, upon reaching the listening position 135, is perceived by the listener as having deficiencies in the target frequency response. The perceived deficiencies may be a result of deficiencies in the performance of speaker 115 and/or acoustical interference between the direct path of direct sound 140 and the reflected path of reflected sound 145, such as comb filtering at the listening position 135. This results in unwanted dips and peaks in the frequency response at the listening position 135. These deficiencies perceived by the listener may be minimized by processing the input signal 110 through the compensation channel 305 and the summing circuit 323. The processed output signal 325 may be sent to the second speaker 125 at a different location in the listening space 127. Because the second speaker 125 is at a different location it is likely to have different interference and so may have different peaks and dips in its response at the listener position 135. Therefore, the compensated signal emitted from the second speaker 125 may be used to try to fill in some of the "holes," or troughs, in the frequency response due to the first speaker 115. Thus, troughs 210 may be filled with peaks 410 of the audio output from the second speaker, while the peaks 205 are substantially unchanged. (FIG. 4)

Such filling of the "holes" may be substantially unnoticed by the listener by taking advantage of psychoacoustics when trying to fill the "holes" in the response of first speaker 115 at the listening position. An audible sound produced by the first speaker 115 in response to the first input signal 110 will typically be perceived at the listening position as sound coming from that direction or location+. When using a compensated version of the first input signal 110 (compensated audio signal 320) to produce audible sound as compensating sound from the second speaker 125 to fill the "holes," the compensation may be appropriately delayed and the energy level appropriately adjusted such that the user still perceives substantially all of the audible sound at the listening position as coming from first speaker 115, or from the direction of the first speaker 115. As such, the listener perceives no movement in the location of the sound source (the first speaker 115) whether the second speaker 125 is producing, or not producing the compensated audio signal to fill the "holes."

Compensation of the first input signal 110 to accomplish substantially no change in the perceived location may include applying a predetermined delay to the compensated audio signal 320 that is emitted by the second speaker 125. The delay may be chosen such that the compensating audible sound produced by the second speaker 125 arrives at the listening position 135 a predetermined period of time after the corresponding audible sound produced from the first speaker 115. In addition, a predetermined energy level adjustment and/or predetermined equalization may be selectively applied to first input signal 110, and/or the compensated audio signal 320 to adjust the spectral energy of the resulting audible sound produced by the first and second speakers 115 and 125. When the combination of audible sound produced by the first and second speakers 115 and 125 reaches the listening position 135, the human ear sums the energy of the delayed sound with the energy of the direct sound when perceiving the originating location and originating direction of the sound. As a result of how the human auditory system and brain works, the listener will still localize the audible sound received as substantially originating from the first speaker 115. There may be limits regarding how loud and how delayed the audible sound produced from second speaker 125 can be with respect to the audible sound produced by the first speaker 115 in order to substantially maintain the location and direction of the sound as perceived by the listener. Such limits may be established by spectral analysis of a listening space, experimentation with test subjects, or any other procedure(s) or test equipment capable of determining limits for delay, energy level, and/or equalization with regard to psychoacoustic location and direction of a source of sound, such as those previously and later described.

The term "substantially" refers to the less than exact correction of deviations in the target response due to the first speaker 115 at the listening location 135, since exact matching of the phase and magnitudes of the signals from speakers 115 and 125 is unnecessary to achieve the desired perceptual effect by the listener. In other words, since cancellation of spectral energy is not being performed, exact matching of the phase of the signals from the speakers 115 and 125 is unnecessary, since addition to the existing spectral energy produced by the first speaker 115 (see FIG. 4) does not require exact matching of the phase of the signals. In addition, "substantially" maintaining the location and direction of sound is desirable to increase the area of the listening location in order to avoid the correction only being accurate at a precise location in the listening space such that relatively small movements by the listener may lessen or defeat the correction. This may be particularly true at relatively higher frequencies of sound that are compensated, where wavelengths are shorter.

By substantially filling the "holes" in the frequency response due to the first speaker 115, the listener perceived response of the first speaker 115 may be improved. Filling, or minimizing, at least some of the troughs in the frequency response due to the first speaker 115 results in improvements in the psychoacoustically perceived magnitude response of the first speaker 115. The processing to add delay to the compensated audio signal 320, relies on how the human ear works to integrate signals from the two different sound sources, such as two different speakers. For example, the human ear may integrate delayed audible sound from the second speaker 125 formed with the compensated audio signal 325 with original audio sound from the first speaker 115 formed with the audio signal 110 such that the delayed sound is not heard as a separate event, and all of the sound appears to come from the direction of the first speaker 115.

This desirable combination of audio sound generated from the first and second speakers 115 and 125 may effectively minimize deviations in the targeted frequency response so long as the delay is not greater than a predetermined amount, such as between 0 milliseconds and about 40 milliseconds to about 80 milliseconds with respect to the corresponding audio content of the audio signal driving the first speaker 115, and the energy level of the audible sound from second speaker 125 is a predetermined amount, such as in a range between about +10 dB and about −20 dB relative to the energy level of the corresponding audio content included in the audible sound generated from the first speaker 115. The predetermined amount of delay may be dependent on frequency of the audio signal being delayed.

By striving to substantially minimize deviations in the target response, instead of completely eliminating such deviations, correction of deviations within the audio system may be more robust, and the effect on the compensation due to movements by the listener may be minimized. As a result, the correction may substantially minimize deviations over a relatively large listening position 135, such as a seating location in a vehicle regardless of the height, movement and head orientation of the listener occupying the listening position 135. Such changes in a listener's position within a listening position 135 may not result in perceptible changes in the magnitude of the response, but can result in changes to the phase of the response. However, since the human ear is less sensitive to differences in phase, listener perceived changes in the minimization of deviations in the target response due to movement within the listening location are advantageously reduced.

The amount of delay provided by delay circuit 310 and equalization provided by equalizer circuit 315 may also be selected to psychoacoustically correct for the audible sound generated by the system in one or more listening locations when the audio system uses speakers having different frequency response characteristics, when the listening space has different reflective surface characteristics, or any other environmental or hardware related characteristics that affect audible sound received from the loudspeakers at the listening positions in a listening space.

Figure 5:
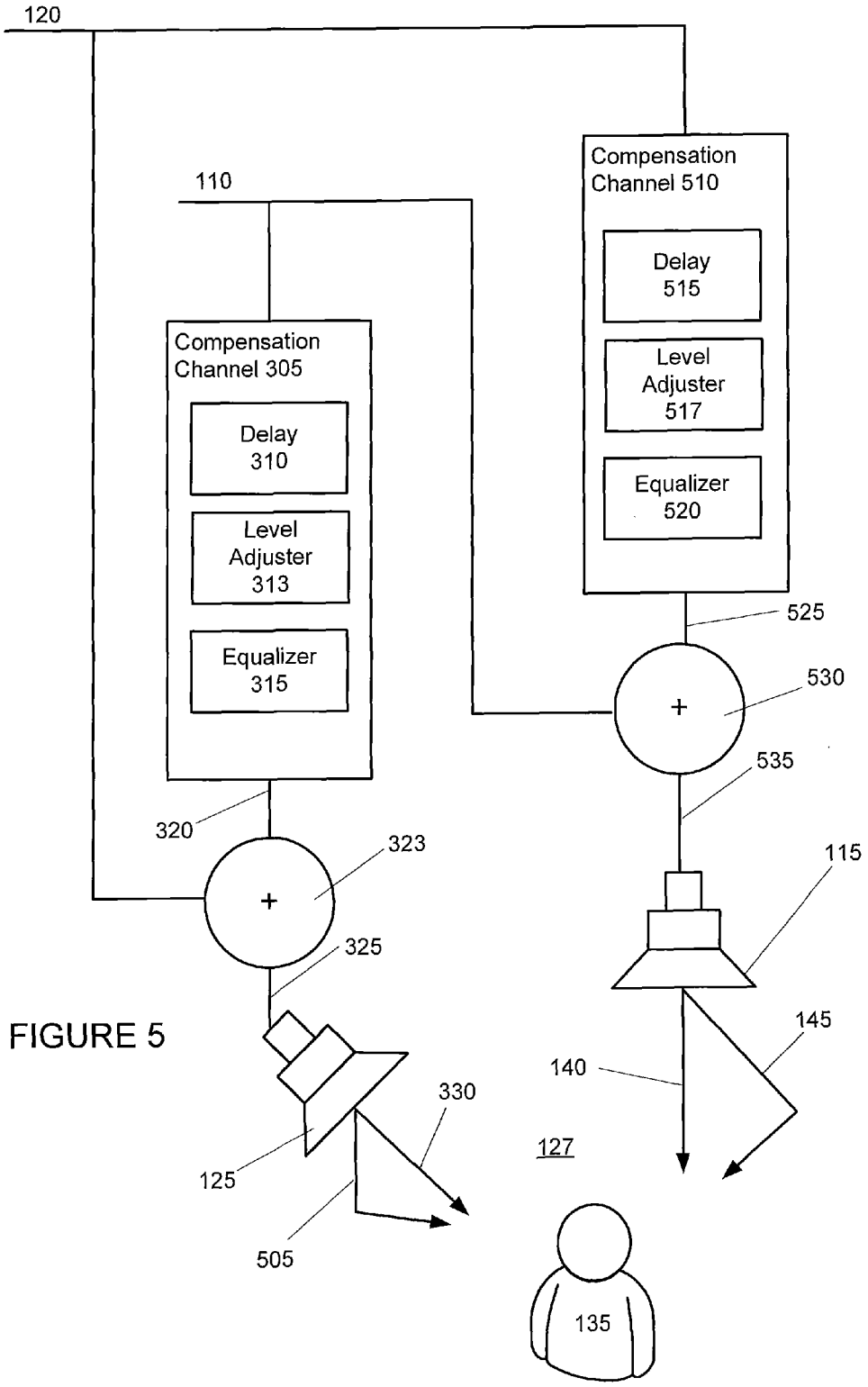
FIG. 5 is a multichannel compensating audio system having channel compensation for multiple channels of the audio system.

FIG. 5 is an example of a multichannel compensating audio system where each channel may include compensation. Compensation channel 305 may be applied in a similar manner as described with reference to FIG. 3. In FIG. 5, a compensation channel is also associated with the second audio signal 120 to compensate for reflected sound 505 emitted from speaker 125. The second audio signal 120, representing one of the channels in a multi-channel audio signal, may be applied to the input of a second compensation channel 510, which includes a series connected second delay circuit 515, a level adjuster circuit 517 and a second equalization circuit 520. The compensation channel 510 generates a second compensated audio signal 525 from the second audio signal 120. The first audio signal 110 and the second compensated audio signal 525 may be applied to the input of a summing circuit 530. The summing circuit 530 adds and/or subtracts the first audio signal 110 and the compensated audio signal 525 with respect to one another to generate a second output signal 535 that is provided to drive the first speaker 115. The first speaker 115 emits sound 140 into the listening environment 127 that corresponds to both the first audio signal 110 and the compensated version 525 of the second audio signal 120 (compensated audio signal 525).

A listener at the listening location 135 may psychoacoustically perceive the location and direction of sound as coming from the respective first and second loudspeakers 115 and 125. However, in reality, the direct and reflected sound 140 and 145 is being compensated to fill holes in the listener perceived soundfield at the listening position 135 using the second speaker 125 and the audio compensated signal 320. Similarly, the direct and reflected sound 330 and 505 is being compensated to fill holes in the listener perceived soundfield at the listening position 135 using the first speaker 115 and the compensated audio signal 525. In other example systems having additional speakers, two or more of the speakers and corresponding compensated audio signals may be used to fill holes in the listener perceived soundfield at the listening position 135 as compensation for either the first or the second speaker 115 and 125.

Figure 6:
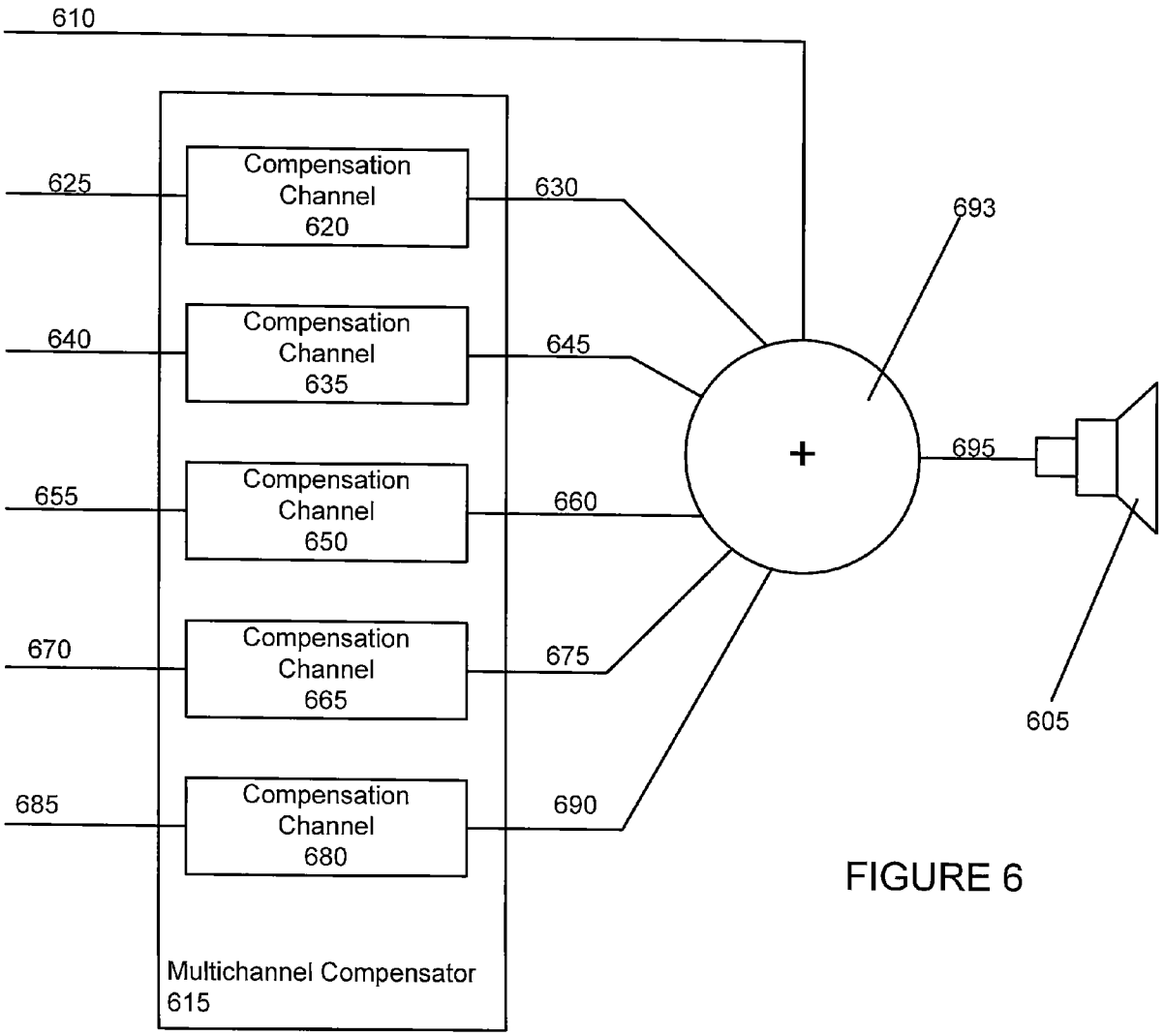
FIG. 6 is a single channel of a multichannel compensating audio system having a multichannel compensator.

FIG. 6 is an example multichannel compensating audio system that includes a compensation system extended to further channels. In such a multichannel compensating audio system, a plurality of audio channels may each provide a respective audio signal. A plurality of compensation channels may be provided that are each respectively associated with the audio signal of a respective audio channel. Each audio compensation channel includes a series connected delay circuit, a level adjuster circuit, and a frequency equalizer circuit that generates a compensated audio signal from the audio signal of the respective audio channel associated with the compensation channel. A plurality of summing circuits may be used to generate audio output signals for provision to corresponding speakers for each channel of the multichannel audio system. The plurality of summing circuits may have inputs for receiving the audio signal from a respective one of the plurality of audio channels and a plurality of compensated audio signals for a remaining plurality of the plurality of audio channels.

A single channel of an example multichannel compensating audio system, such as a 5.1 audio system, is shown in the example of FIG. 6. Only a single channel speaker 605 is illustrated for simplicity. For purposes of the following discussion, it is assumed that speaker 605 is the right front (RFC) speaker and is associated with the audio signal 610 of the right front channel of the audio system. The audio signals for the remaining channels other than the RFC of the audio system are provided to a multichannel compensator 615 that is respectively associated with the RFC.

The multichannel compensator 615 includes a compensation channel for each audio signal other than the RFC. In other examples, the multichannel compensator 615 may include compensation channels for less than the entirety of the remaining audio channels. In FIG. 6, compensation channel 620 receives an audio signal 625 corresponding to the center front channel (CFC) of the audio system and generates a corresponding compensated CFC audio signal at 630. Compensation channel 635 receives an audio signal 640 corresponding to the left front channel (LFC) of the audio system and generates a corresponding compensated LFC audio signal at 640. Compensation channel 650 receives an audio signal 655 corresponding to the left rear channel (LRC) of the audio system and generates a corresponding compensated LRC audio signal at 660. Compensation channel 665 receives an audio signal 670 corresponding to the right rear channel (RRC) of the audio system and generates a corresponding compensated RRC audio signal at 675. Compensation channel 680 receives an audio signal 685 corresponding to the low frequency effects (LFE) channel of the audio system and generates a corresponding compensated LFE audio signal at 690 that is representative of the low frequency portion of the audio signal.

Audio signal 610 and each compensated audio signal 630, 645, 660, 675, and 690 are provided to a summing circuit 693. The summing circuit 693 adds and/or subtracts the audio signals at its input to generate an output signal 695 that is provided to speaker 605. As such, the audio signal 695 provided to speaker 605 corresponds to a non-compensated version of audio signal 610 for the audio channel as well as compensated audio signals for each of the remaining audio channels. Depending on the design criterion, compensated audio signals for certain channels need not be provided by the multichannel compensator 615.

Figure 7:
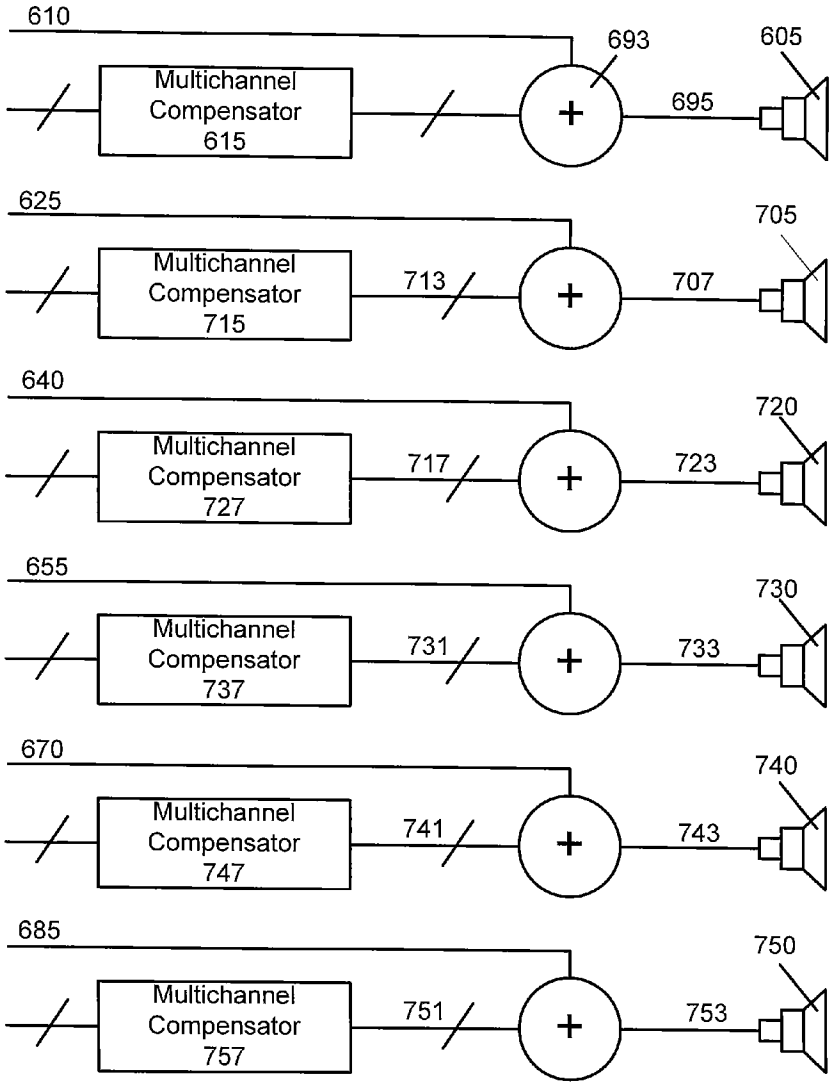
FIG. 7 shows channel compensation for all channels of a multichannel compensating audio system.

The system topology may be extended to each audio channel of the remaining audio channels as shown in FIG. 7. For example, the speaker 705 for the CFC channel accepts an output signal 707 corresponding to a non-compensated version of the CFC audio signal 625 and compensated versions of the RFC, LFC, RRC, RLC, and LFE audio signals 713 provided from multichannel compensator 715. The speaker 720 for the LFC accepts an output signal 723 corresponding to a non-compensated version of the LFC audio signal 640 and compensated versions of the RFC, CFC, RRC, RLC, and LFE audio signals 717 provided from multichannel compensator 727. The speaker 730 for the RRC channel accepts an output signal 733 corresponding to a non-compensated version of the RRC audio signal 655 and compensated versions of the RFC, CFC, LFC, RLC, and LFE audio signals 731 provided from multichannel compensator 737. The speaker 740 for the RLC accepts an output signal 743 corresponding to a non-compensated version of the RLC audio signal 670 and compensated versions of the RFC, CFC, LFC, LLC, and LFE audio signals 741 provided from multichannel compensator 747. The speaker 750 for the LFE channel accepts an output signal 753 corresponding to a non-compensated version of the LFE audio signal 685 and compensated versions of the RFC, CFC, LFC, LLC, and RRC audio signals 751 provided through multichannel compensator 757. Although the multichannel audio system of FIG. 6 and FIG. 7 is described in the context of a 5.1 channel system, this topology may be extended to multichannel audio systems having a larger number of audio channels, such as a 6.1 or 7.1 system, or fewer number of audio channels, such as a stereo system.

Figure 8:
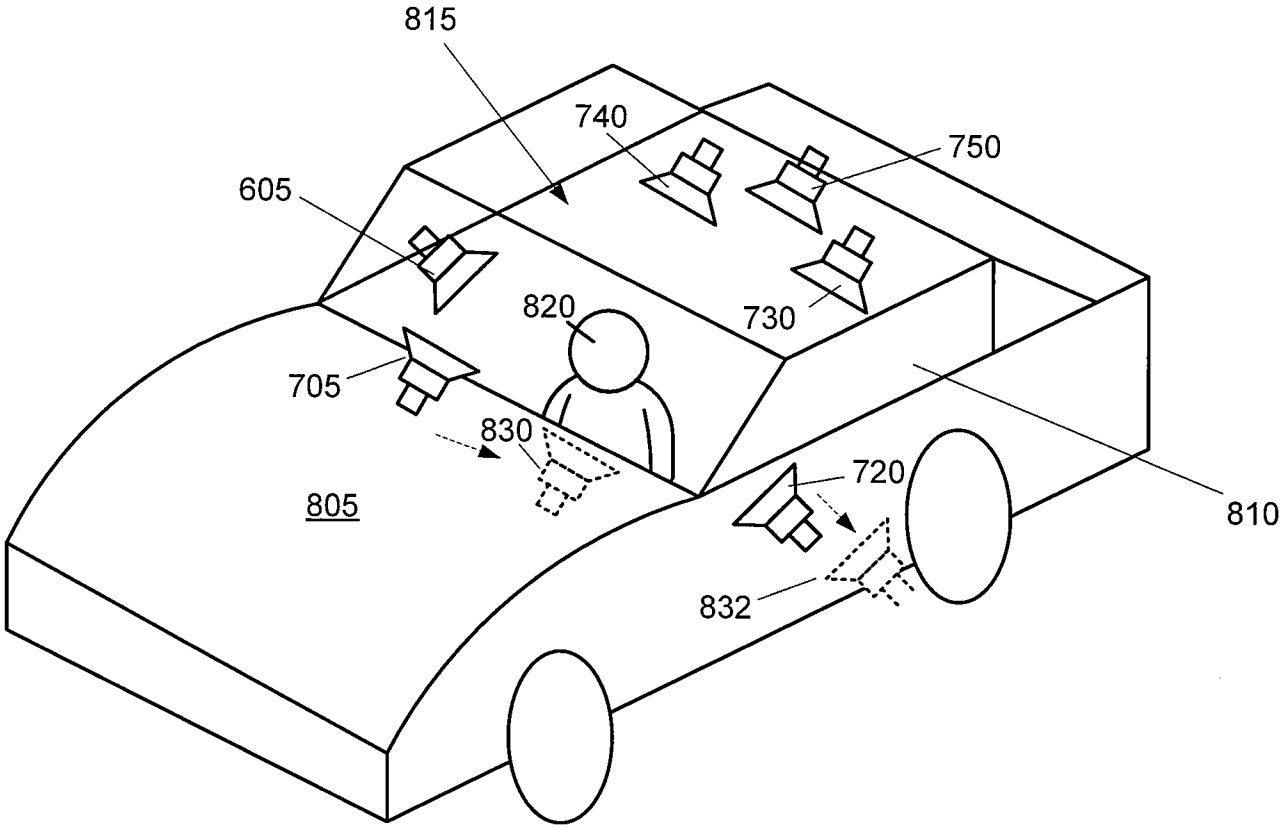
FIG. 8 shows the channel speakers of a multichannel compensating audio system used in a passenger cabin of a vehicle.

FIG. 8 is an example of the placement of speakers of a multichannel compensating audio system, such as a 5.1 system, in a vehicle 805. The speakers of the system of FIG. 8 emit sound into a listening environment 815 formed by the passenger cabin of the vehicle 805. In this example, a listening position 820 in the form of the drivers seat is located in the listening environment 815.

Each compensation channel of the audio system may have its own unique delay, level adjustment and equalization characteristics. These characteristics may be selected based on the psychoacoustic perceptions of the listener in the listening position 820 within the listening environment 815. To this end, the listener in the listening position 820 may be replaced by a binaural dummy head. The binaural dummy head may be placed at a fixed and/or multiple listening locations within the listening environment 815, such as a driver position, front passenger position, and rear passenger positions. The delay, energy level, and equalization characteristics of the compensation channels may be adjusted using sound measurements detected at the binaural dummy head. The sound measurements at the binaural dummy head may be compared with a variety of sound measurements associated with various psychoacoustic properties. The delay, energy level and equalization for the compensation channels may be varied until the sound measurements detected at the binaural dummy head correspond with the desired psychoacoustic properties at each of the listening positions.

The binaural dummy head may be moved to multiple listening locations within the listening environment 815 while varying the delay, level adjustment, and equalization characteristics of the compensation channels. In this way, the delay. energy level, and equalization values of the compensation channels may be set to values that provide psychoacoustic perception properties that would be acceptable to all of the listeners in different listening positions within the listening environment 815.

The multichannel audio system of vehicle 805 may include multiple delay, energy level, and equalization settings that are optimized for psychoacoustic perception of audio by a listener at one or more listening locations in the listening environment 815. To this end, the listener in a particular listening position may be provided with selections associated with a listener at one or more of the listening positions within the environment 815 (i.e., driver position, rear cabin, passenger position, all). In FIG. 8, the listening position 820 is at the driver's position, which corresponds to selection of "driver position" on the audio system user interface. When selected, the delay, energy level and equalization values of the compensation channels may be used to substantially minimize deviations in the target response in the listening position 820 with respect to all, or some of the speakers 605, 705, 720, 730, 740, 750 while maintaining the perceived locations and directions of the sound as coming from the speakers 605, 705, 720, 730, 740, 750.

Alternatively or in addition, the delay, energy level and equalization values of the compensation channels may be used to substantially minimize deviations in the target response and also generate one or more virtual channel speaker sounds that are psychoacoustically perceived by the listener at a location other than the location of the actual physical position of the corresponding channel speaker. For example, application of the delay and equalization values to the audio channels may result in virtual movement of speaker 705 for the CFC to the virtual speaker position shown at 830 and/or virtual movement of speaker 720 to the virtual speaker position shown at 832. The new virtual speaker positions 830 and/or 832 effectively shifts the CFC and/or the LFC so that it is perceived at a location that is more appropriate for the CFC and/or LFC for a listener at the driver's listening position 820. A similar virtual speaker shift may be provided for any one or more of the remaining speakers. In this manner, substantially all or some of the speakers may be psychoacoustically shifted (in this case, counterclockwise) with respect to the actual locations of the channel speakers so that the system is perceived by the listener in the listening position 820 as though the listener is positioned at a central location within the listening environment 815. Other position optimizations may also be selected through the audio system interface. For example, when a user selects the "all" option, the compensation channels may be set to delay, energy level, and equalization values that provide psychoacoustic perception properties that would be generally acceptable to listeners in all of the listening positions in the environment 815.

The speakers of a multichannel audio system may not necessarily have the same sound reproduction quality or frequency response range with respect to one another. The use of different quality speakers for different channels within the listening environment 815 may be imposed by system design constraints. For example, in the case of a listening space in a vehicle, the speaker 705 for the CFC may have its size constrained by the limited availability of space in the vehicle's dashboard. The remaining speakers may have additional space available to them so that higher quality speakers or speakers with a wider desirable frequency response range may be used for the other channels. As such, two or more speakers may have different psychoacoustically perceived audio frequency responses across an audio frequency range in the listening environment 815. The delay, energy levels and frequency characteristics of the compensation channels may be used to alter the psychoacoustically perceived audio frequency response of at least one of the two or more speakers having different psychoacoustically perceived audio responses.

For purposes of this discussion, the CFC speaker 705 may have a generally irregular frequency response across the audio frequency range when compared to one or more of the other channel speakers of the audio system. The delay, energy level and frequency characteristics of the compensation signals provided by the other channels of the system may be used to correct for this "irregular" frequency response so that the psychoacoustically perceived frequency response of the CFC speaker 705 approaches a target frequency response, such as a substantially flat frequency response within a desired range of frequencies. Additionally, or alternatively, the delay and frequency characteristics of the compensation signals provided by the other channels of the system may be used to correct for this "irregular" frequency response so that the psychoacoustically perceived frequency response of the CFC speaker approaches the psychoacoustically perceived frequency response of the other channel speakers of the audio system, irrespective of whether the other channel speakers have a desired target frequency response, such as a generally flat frequency response over a desired range of frequencies.

Quality correction may also be made using the compensation to minimize undesirable speaker characteristics such as colouration, distortion, and any other undesirable speaker characteristics. Such correction for channel speakers having different performance characteristics in the audio system may also be extended to speakers other than the CFC speaker 705.

Figure 9:
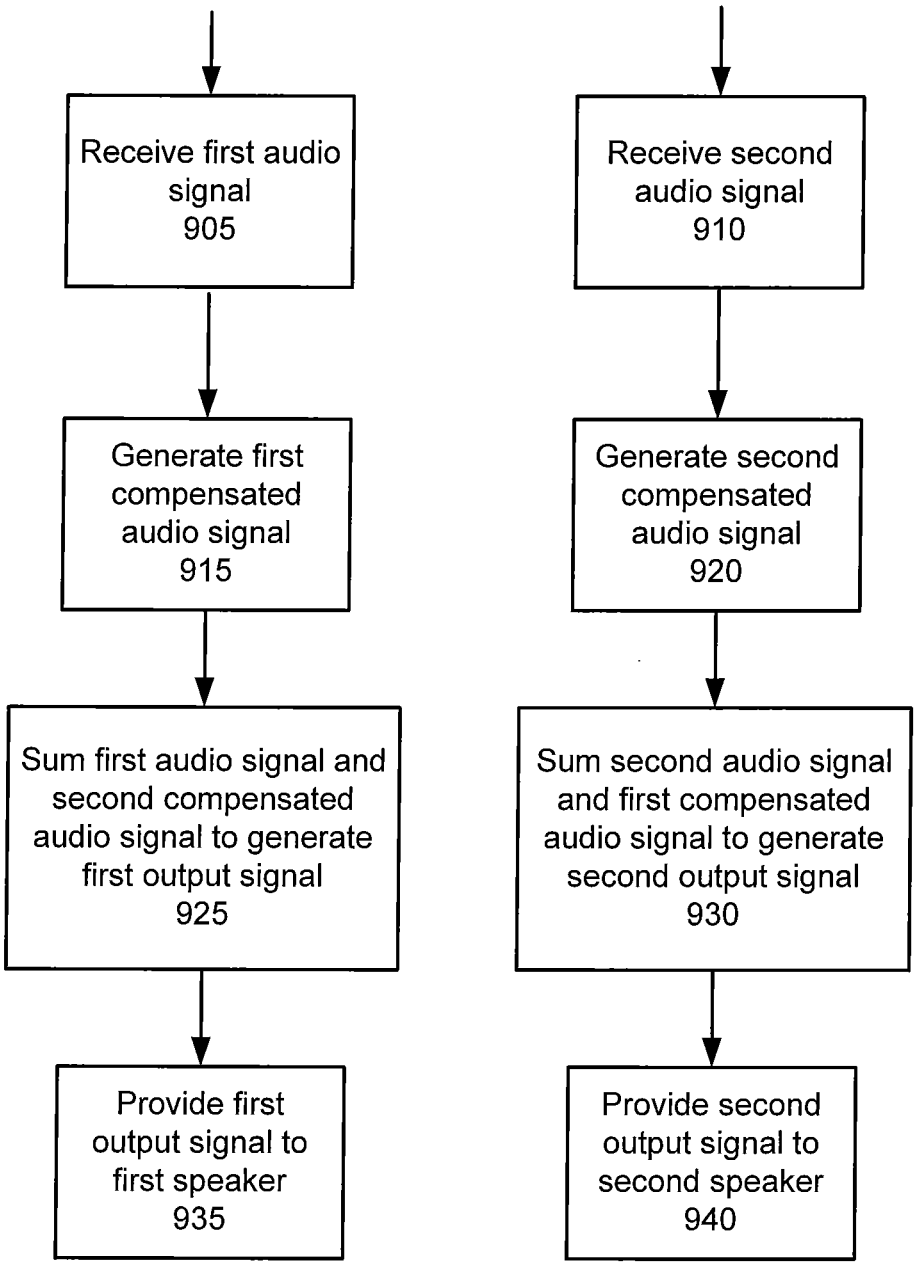
FIG. 9 is a method for operating a multichannel compensating audio system having channel compensation.

An example method for operating a multichannel compensating audio system is illustrated in FIG. 9. At 905 the audio system receives a first audio signal, and a second audio signal is received at 910. A first compensated audio signal corresponding to the first audio signal is generated at 915. The first compensated audio signal corresponds to a delayed, level shifted, and equalized version of the first audio signal. A second compensated audio signal corresponding to the second audio signal is generated at 920. The second compensated audio signal corresponds to a delayed, level shifted, and equalized version of the second audio signal. The first audio signal and second compensated audio signal are summed at 925 to generate a first output signal while the second audio signal and first compensated audio signal are summed to generate a second output signal at 930. The first output signal is provided to a first speaker at 935. The second output signal is provided to a second speaker at 940. The delay, energy level shift, and equalization values used to generate the first and second compensated audio signals may be selected to correct for deviation in a desired targeted response at one or more listening locations without changing a psychoacoustically perceived location and direction of sound generated with the first and second speakers. In addition or alternatively, the first and second compensated audio signals may be used to generate a virtual speaker sound that is psychoacoustically perceived by a listener in a listening environment at a location other than the actual locations of the first and second speakers in that listening environment. Further, the delay, energy level shift and equalization values may be selected to correct for differences in the acoustic quality of the speakers used in the audio system.

Figure 10:
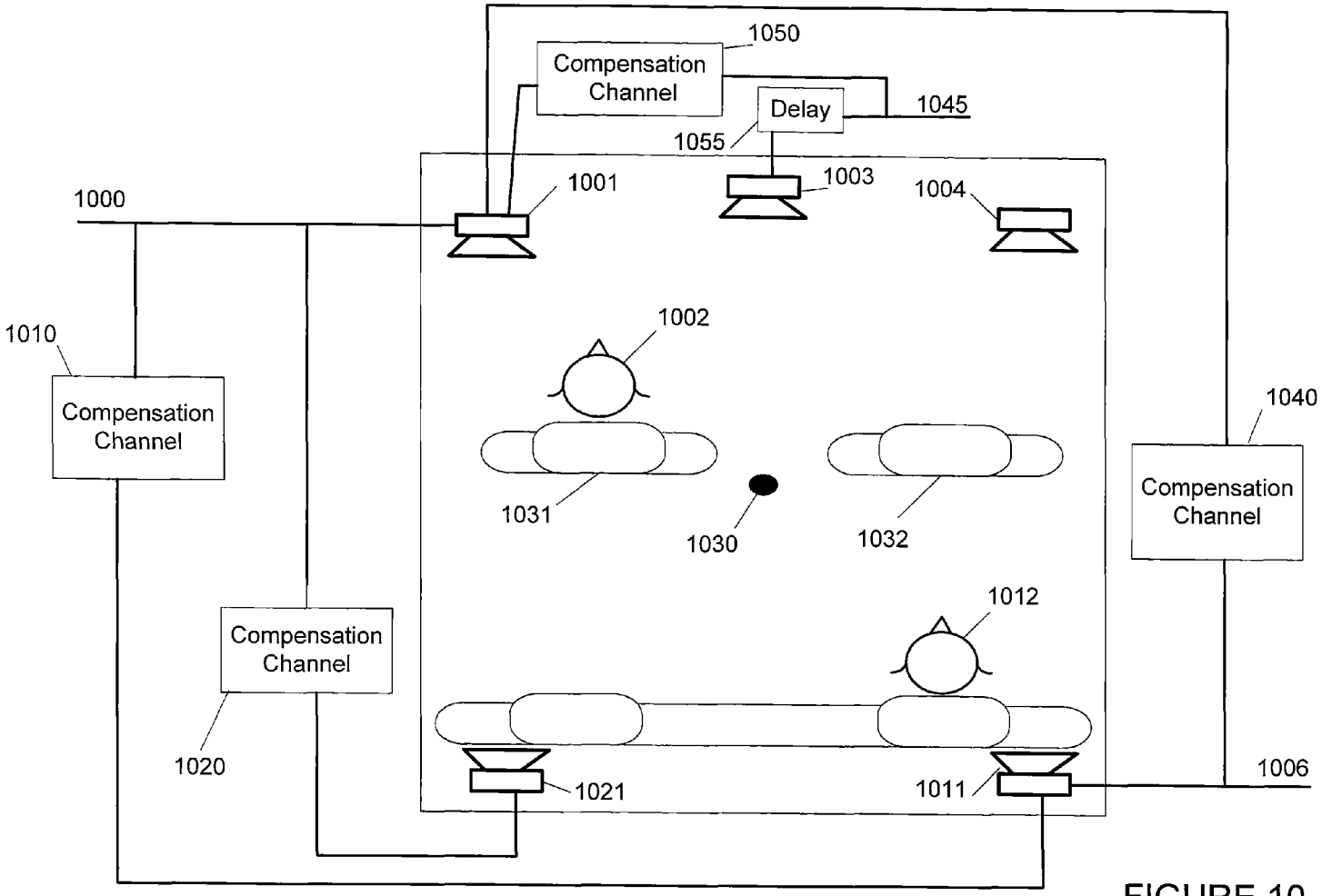
FIG. 10 is an example multichannel compensating audio system used in a passenger cabin of a vehicle.

FIG. 10 is another example multichannel compensating audio system included in a listening environment in the form of a vehicle. Although illustrated as a passenger compartment of a vehicle having five speakers, in other examples, any other listening area and any number of loudspeakers may be used. With further reference to FIGS. 1 through 9, consider a signal going to a center speaker 1003 and arriving at listener position 1002. For at least two different reasons the frequency response at the listener position 1002 may deviate from a desired target response. One possible reason is that the center speaker 1003 may have a frequency response that is inherently different from the desired target response. For example, the center speaker 1003 may have dips and peaks in its response. Another example would be when speaker 1003 is physically small and therefore not able to adequately reproduce audio content having low frequencies. This may be the case for the center channel speaker in a vehicle. Under these circumstances, other speakers, such as a left front speaker 1001 may be used to generate compensation audio based on a compensated audio signal to try to improve the perceived response of center speaker 1003 at the first listening location 1002.

As previously discussed, the center channel audio signal is sent to the center speaker 1003. In addition, the center channel audio signal may be processed to create the compensated audio signal that is sent to the left front speaker 1001. The processing is designed to make the perceived response of the center channel speaker 1003 appear to be closer to the target response at listening location 1002. This correction in the perceived response may be specific to the listening location 1002.

The delay and level of the compensated audio signal can be set such that the sound source is psychoacoustically perceived by a listener at the listening location 1002 to still sound like it is coming from the center speaker 1003. Thus, predetermined delay can be applied to the compensation audio signal at the left front speaker 1001 so that the sound source remains localized at the center speaker 1003 from the perspective of a listener at the listening position 1002. In addition, a predetermined energy level should be set for the compensated audio signal so that the compensating audible sound generated from the left front speaker 1001 is loud enough to adequately fill in the "holes" (such as troughs) in the response from the center speaker 1003. Therefore, the delay can be maintained below a threshold level to avoid the situation where the compensation signal cannot be made loud enough without causing perception by the listener at the listening location 1002 that the apparent sound source has shifted away from center speaker 1003.

In this example, the left front speaker 1001 is closest to the listening position 1002, and thus may have the most effect on this listening location 1002 due to the loudness (level) of a speaker diminishing as a listener is positioned further away from the speaker, and due to obstacles in the listening area. For example, in a vehicle, such obstacles in the listening area may include the driver and the front seats 1031 and 1032, which can act as acoustical barriers and attenuate the sound emanating from the left front speaker 1001 that reaches a second listening position 1012. The compensation effects due to the left front speaker 1001 may be substantially inaudible at other listening positions in the vehicle for these reasons, which may provide less detrimental effects on the other listening locations in the vehicle. In other words, the correction for the listening position 1002 due to the left front speaker 1001 may be largely independent of corrections for other listening positions in the vehicle.

In the case of the second listening position 1012, a different compensation process for the center speaker 1003 may be applied. For example, a listener in the second listening position 1012 may hear audio content produced from the center speaker 1003 but it may be attenuated when compared to listening position 1002 due to the greater distance and the front seats 1031 and 1032 acting as obstacles. The attenuation due to the front seats 1031 and 1032 may be frequency dependent. Therefore, a compensation signal may be applied to a right rear speaker 1011 to correct for the response of center speaker 1003 at the second listening location 1012. The choice of delay and energy level for this compensation signal may be guided by the actual measurements, surveys, or any other mechanism, as previously discussed. In one example, more delay may be applied to left rear speaker 1011 than was applied to left front speaker 1001 due to a first distance from the left front speaker 1003 to the listening location 1012 being greater than a second distance from the right rear speaker 1011 to the listening location 1002. Accordingly, a level of the audible sound produced by the right rear speaker 1011 may be relatively louder without the listener in the second listening position 1012 perceiving that the location of the center speaker 1003 has changed. In addition, since the right rear speaker 1011 is close in proximity to the second listening location 1012 as compared to the other listening locations, this speaker will have the greatest effect on the audible sound perceived by a listener positioned in the second listening location 1012.

In another example, compensated audio signals may be used to enable a listener to perceive that the individual speaker channels sound substantially equally loud at substantially all listener locations. For this example, consider a LFC signal 1000 on a left front channel of a multichannel sound source. Such multichannel sound sources may include a compact disc, broadcast audio content, live audio content, a DVD, an MP3 file, or any other live or pre-recorded audio content provided as an input signal. In addition, multichannel sound sources may include any device or mechanism capable of creating multi-channel audio content, such as an upmixer for converting audio content having fewer audio channels to audio content having additional audio channels, or a downmixer for converting audio content having many audio channels to audio content having fewer audio channels. The LFC signal 1000 may be channeled to and emitted by the left front speaker 1001. The acoustical energy level of the LFC signal 1000 may be much louder at the first listener location 1002 than it is at the second listener location 1012. This is due to the difference in distance, as well as the acoustic barriers between the first and second listening locations 1001 and 1012. Conversely, consider a RRC signal 1006 provided on a right rear channel from the sound source. The RRC signal 1006 may be emitted as audible sound by the right rear speaker 1011. The acoustical energy level of the RRC signal 1006 may be much louder at the second listening location 1012 than it is at the first listening location 1002.

Also as part of this example, consider a third listening location 1030 that is located at approximately the center of the listening area. At the third listening location 1030, the sounds from each of the speakers 1001, 1003, 1004, 1011 and 1021 of this example can be perceived by a listener in the third listening position 1030 as being substantially equal. Although this is a desired result for optimal multichannel playback, in the example vehicle provided, not only is there no seating position for a listener at this location, but also the other listening positions within the listening area may not perceive a similar experience.

With a multichannel compensating audio system, all of the output channels from the sound source may be perceived by listeners in the listening locations as being substantially equally loud. In the first listener location 1002, for example, the sound from the left front speaker 1001 can be made substantially equal in perceived loudness to the sound from the right rear speaker 1011 without the compensation system, by simply increasing the level of audible sound produced by the right rear speaker 1011 to offset attenuation that the audible sound produced by the right rear speaker 1011 experiences in its audio path to the first listening location 1002. Although simply increasing the audible sound produced by the right rear speaker 1011 could indeed resolve unequal sound levels perceived at the first listener location 1002, it could also aggravate unequal sound levels perceived at the second listener location 1012. In some cases, at the second location 1012, the signal from the right rear speaker 1011 may already be perceived by a listener as louder than the signal from the left front speaker 1001. By increasing the level of audible sound produced by the right rear speaker 1011 to accommodate the first listening location 1002, the imbalance in loudness may be made even worse at the second listening location 1012.

Use of compensated audio signals with adjusted delay and energy levels may solve such imbalanced loudness at different listening positions. For example, in FIG. 10 consider the second listening location 1012 in a situation where the signal from the right rear speaker 1011 is louder than the signal from the left front speaker 1001. In this example, the LFC signal 1000 on the left front channel may be processed through a compensation channel 1010, which consists of the delay circuit, the level adjuster circuit, and the equalizer (EQ) circuit. The settings for compensation channel 1010 may be predetermined as previously discussed. The compensation delay may be set to be at least long enough so that the sound from the left front speaker 1001 reaches the second listener position 1012 before the compensated audio signal from the right rear speaker 1011. More generally, the delay and energy level may be set so that the sound source continues to be psychoacoustically perceived by the listener in the second listening position 1012 as coming from speaker 1001. The delay and energy level parameters may be set at a compensation channel 1010 so that the sound from the LFC signal 1000 of the sound source is psychoacoustically perceived by a listener at the second listener position 1012 as substantially equal in magnitude of spectral energy (substantially equally loud) as the sound from the RRC signal 1006 of the sound source. At the same time, the delay and energy level parameters may be set at a compensation channel 1040 so that the sound from the RRC signal 1006 of the sound source is perceived by a listener at the first listener position 1002 as equally loud to the sound from the LFC signal 1000 of the sound source.

The EQ may be set on the compensation channel 1010 to compensate for the response of speaker 1001 at the second listening location 1012. The EQ of the compensation channel 1010 can also be used to attenuate the higher frequencies relative to the level of the lower frequencies. This may done to account for the fact that the human ear does not integrate higher frequencies as readily as lower frequencies. Therefore, for a given delay, the higher frequencies may be attenuated by a predetermined amount in order to prevent the compensation signal from being audible as a separate sound source, and/or to prevent LFC signal 1000 from shifting its perceived location away from its front-left location.

In some situations it may not be possible to make the compensated audio signal at the right rear speaker 1011 loud enough so that the LFC signal 1000 and the RRC signal 1006 of the sound source sound equally loud at the second listener position 1012. There may be a limit as to how loud the compensation signal at the right rear speaker 1011 can become before the listener begins to experience a perceived shift in the sound image, or before the audible compensated audio signal from the right rear speaker 1011 is no longer integrated with the signal from the left front speaker 1001 by the listener's ear at the second listening location 1012. When the compensation signal from the right rear speaker 1011 is no longer integrated with the signal from 1001, then the signal from the right rear speaker 1011 will start to be heard as a separate sound source. To address this, additional compensation channels may be employed in order to try to increase the perceived loudness of the LFC signal 1000 at the second listener location 1012. In FIG. 10, a second compensation channel 1020, processes the LFC audio signal 1000 and creates a second compensation signal to be emanated from a left rear speaker 1021. The second compensation signal may be used to supplement the first compensated audio signal from the right rear speaker 1011. The delay, energy level and EQ may be predetermined as previously discussed. The nearest speaker to the listener location may be used as the first compensation channel for that listener location, with subsequent compensation channels configured in accordance with need and desirable effect on the perceived sound at the listener location.

In another example, it is desirable to move the perceived location of an individual speaker channel using the multichannel compensating audio system. In the example of a multichannel compensating audio system in a vehicle, consider the center speaker 1003 which is physically located in the front and center of the listening space, such as on the center of the dashboard in the vehicle. When the center channel signal from a sound source is sent to the center speaker 1003, the listener at the first listening location 1002 may perceive the sound to come from the physical location of the center speaker 1003. In some situations this is acceptable and desirable. However, some listeners may prefer to acoustically perceive the center channel sound as appearing to come from directly in front of them, even when the center speaker 1003 does not occupy that physical location. In addition, at the same time, the perceived center channel sound source should also be perceived by other listeners in other listening locations in the listening space as directly in front of all of those other listeners.

This may be accomplished with the multichannel compensating audio system by sending a center frequency (CFC) signal 1045 from the sound source to the center speaker 1003. At the same time the CFC signal 1045 may be processed through a fourth compensation channel 1050 and the compensated audio signal may be provided to the left front speaker 1001. Predetermined values of the delay, EQ, and the energy level may be chosen for the fourth compensation channel 1050 as previously discussed. In this case, it is possible to allow the compensation signal emitted by left front speaker 1001 to arrive at the first listener position 1002 before the signal from center speaker 1003 arrives at the first listening position 1002. To achieve this, the CFC signal 1045 may be delayed in going to the center speaker 1003 using a delay circuit 1055.

The compensating delay applied by the delay circuit 1055 for the center speaker 1001 could be positive or negative with respect to the time of arrival of the signal from the left front speaker 1003 at the first listening location 1002. The predetermined level of the compensated audio signal emitted by the left front speaker 1001 may be chosen based on the chosen delay as well as the relative physical locations of the left front speaker 1001 and the center speaker 1003 with respect to the first listener position 1002. In order to move the perceived sound source to a point directly in front of a listener in listening position provided by the seat 1032, a substantially similar compensated audio signal may be provided to the right front speaker 1004. A similar process may be used with left rear speaker 1021 and right rear speaker 1011 to provide a perceived center channel audio source for the second listening position, and other listening positions, such as in the rear seat of a vehicle. Also, multiple speakers may be used to move the position of a given audio source channel signal to a desired perceived location.

Using the compensation system, different listeners in different listening positions can have different perceived locations for the same sound source channels at the same time. For example, in a vehicle the driver may want the center channel audio signal from a sound source to be perceived as appearing directly in front of the driver seat, while the front seat passenger may want the center channel audio signal to be perceived as appearing to come from the center of the dashboard where the center speaker 1003 is physically located.

A similar process may be used on all of the sound source channel signals in order to make them appear to come from desired locations. In addition to moving a perceived speaker location from side-to-side, the compensation system may also provide for movement of a perceived speaker location forward or backwards in a listening area. Moreover, if the audio system includes one or more speakers that are physically positioned in an elevated location with respect to other speakers in the audio system, a perceived speaker location may be moved vertically up and down within a listening space. For example, where one or more speakers are physically positioned above one or more listening positions, such as mounted in the headliner of a vehicle, a perceived speaker location may be moved vertically up and down within the listening space of the vehicle. Accordingly, the perceived locations of the sound source channel signals may be selectively elevated. Similarly, the perceived locations of the sound source channel signals may be selectively lowered.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. An audio system comprising:

a first compensation channel configured to receive a first audio signal, the first compensation channel including a series connected delay circuit and frequency equalizer circuit to generate a first compensated audio signal;

a second compensation channel configured to receive a second audio signal, the second compensation channel including a series connected delay circuit and frequency equalizer circuit to generate a second compensated audio signal;

a first summing circuit having inputs to receive the first audio signal and the second compensated audio signal, where the first summing circuit generates an output signal for provision to a first speaker to generate a first audible sound; and a second summing circuit having inputs to receive the second audio signal and the first compensated audio signal, where the second summing circuit generates an output signal for provision to a second speaker to generate a second audible sound, and where the first compensated audio signal is configured to drive the second speaker to constructively add, at a listening position, the first compensated audio signal to the first audible sound generated by the first speaker and where the first compensated audio signal arrives at a predetermined delay after an arrival of the first audible sound and is psychoacoustically perceived at the listening position as arriving with the first audible sound, and where the second compensated audio signal is configured to drive the first speaker to constructively add, at the listening position, the second compensated audio signal to the second audible sound generated by the second speaker and where the second compensated audio signal arrives at a predetermined delay after an arrival of the second audible sound and is psychoacoustically perceived at the listening position as arriving with the second audible sound, where the constructive additions at the listening position compensate for deviations in a target frequency response at the listening position.

2. The audio system of claim 1, where the output of the first summing circuit is in electrical communication with the first speaker and the output of the second summing circuit is in electrical communication with the second speaker.

3. The audio system of claim 2, where the first and second speakers are located in a listening environment, and where sound output from the first and second speakers combine to generate a virtual speaker sound that is psychoacoustically perceived by a listener in the listening environment at a location other than a location of actual positions of the first and second speakers.

4. The audio system of claim 2, where the first and second speakers are located in a listening environment, and where the first and second speakers have different audio frequency responses across an audio frequency range in the listening environment.

5. The audio system of claim 4, where the first compensation channel produced as audible sound by the second speaker has delay and frequency equalization characteristics that alter the psychoacoustically perceived audio frequency response of sound from the first speaker in the listening environment without changing a listener perceived physical location of the first speaker.

6. The audio system of claim 5, where frequency equalization characteristics of the second audible sound produced by the second speaker are in a frequency range of the first audible sound produced by the first speaker.

7. The audio system of claim 5, where the second compensation channel produced as audible sound by the first speaker has delay and frequency equalization characteristics that alter the psychoacoustically perceived audio frequency response of the second audible sound from the second speaker in the listening environment without changing a listener perceived physical location of the second speaker.

8. The audio system of claim 7, where frequency equalization characteristics of audible sound produced by the first speaker are in a frequency range of the second audible sound produced by the second speaker.

9. The audio system of claim 5, where the second speaker has a generally flat frequency response characteristic across the audio frequency range and the first speaker has a generally irregular frequency response across the audio frequency range, and where the first compensation channel produced as audible sound by the second speaker is configured to reduce the irregularity of the frequency response of the sound from the first speaker when psychoacoustically perceived in the listening environment.

10. The audio system of claim 1, where the first compensation channel and the second compensation channel each further include a level adjuster circuit, the level adjuster circuit configured to selectively provide adjustment of a global magnitude of spectral energy of the first compensated output signal and the second compensated output signal.

11. The audio system of claim 2, where the first and second speakers are located in a passenger cabin of a vehicle.

12. A multichannel audio system comprising:

a plurality of audio channels providing respective audio signals;

a plurality of compensation channels each respectively associated with the audio signal of a respective audio channel of the plurality of audio channels, where each of the audio compensation channels includes a series connected delay circuit and frequency equalizer circuit to generate a compensated audio signal from the audio signal of the respective audio channel; and a plurality of summing circuits configured to generate audio output signals for provision to corresponding speakers for at least some of the audio channels;

one of the summing circuits having a first audio output signal to drive a first speaker to produce a first frequency response and having inputs configured to receive the audio signal from a first respective audio channel of the plurality of audio channels and at least one compensated audio signal generated from the audio signal of at least one second respective audio channel of the plurality of audio channels, and the at least one second respective audio channel of the plurality of audio channels is configured to drive a second speaker to produce a second frequency response, where the at least one compensated audio signal included in the first frequency response is configured to constructively combine with the second frequency response at a listening position to minimize deviations in a targeted frequency response at the listening position without changes to a listener perceived location of the second speaker, wherein the at least one compensated audio signal arrives to the listening position at a predetermined delay after an arrival of the second frequency response and is psychoacoustically perceived at the listening position as arriving with the second audible sound.

13. The multichannel audio system of claim 12, where the output of each summing circuit is in electrical communication with its corresponding speaker.

14. The multichannel audio system of claim 13, where the speakers for each channel of the multichannel audio system are located in a listening environment, and where sound output from the speakers combine to generate a virtual speaker that is psychoacoustically perceived by a listener in the listening environment at a location other than an actual position of one or more of the speakers.

15. The multichannel audio system of claim 13, where the speakers for each channel of the multichannel audio system are located in a listening environment, and where two or more of the speakers have different psychoacoustically perceived audio frequency responses across an audio frequency range in the listening environment.

16. The multichannel audio system of claim 15, where the compensation channels have delay and frequency characteristics that alter the psychoacoustically perceived audio frequency response of at least one of the two or more speakers having different psychoacoustically perceived audio frequency responses.

17. The multichannel audio system of claim 16, where the at least one of the two or more speakers has a generally irregular frequency response across the audio frequency range when compared to one or more other speakers of the multichannel audio system.

18. The multichannel audio system of claim 12, where each of the plurality of compensation channels includes a level adjuster circuit, the level adjuster circuit configured to adjust a global energy level of the compensated audio signal.

19. The multichannel audio system of claim 13, where the speakers for each channel of the multichannel audio system are located in a listening environment, and where sound output from the speakers combine to generate a sound field in different listening positions within the listening environment that is psychoacoustically perceived by a listener in the listening environment as being substantially equally contributed to by at least a plurality of the speakers.

20. A method for operating a multichannel audio system comprising:

receiving a first audio signal;

generating a first compensated audio signal by executing a series delay and frequency equalization on the first audio signal;

receiving a second audio signal;

generating a second compensated audio signal by executing a series delay and frequency equalization on the second audio signal;

generating a first output signal for provision to a first speaker by summing the first audio signal and the second compensated audio signal;

generating a second output signal for provision to a second speaker by summing the second audio signal and the first compensated audio signal;

generating, by the first speaker, a first speaker output based on the first output signal, the first speaker output comprising a frequency response of the first audio signal and a frequency response of the second compensated audio signal;

generating, by the second speaker, a second speaker output based on the second output signal, the second speaker output comprising a frequency response of the second audio signal and a frequency response of the first compensated audio signal; and minimizing deviation in a target frequency response at a listening position without changes in psychoacoustically perceived physical locations of the first speaker and the second speaker by constructively combining, at the listening position, the frequency response of the first audio signal and the frequency response of the first compensated audio signal where the first compensated audio signal arrives at a predetermined delay after an arrival of the first audible sound and is psychoacoustically perceived at the listening position as arriving with the first audible sound, and constructively combining, at the listening position, the frequency response of the second audio signal and the frequency response of the second compensated audio signal where the second compensated audio signal arrives at a predetermined delay after an arrival of the second audible sound and is psychoacoustically perceived at the listening position as arriving with the second audible sound.

21. The method of claim 20, further comprising providing the first and second output signals to the first and second speakers, respectively.

22. The method of claim 21, where the second speaker has a generally flat frequency response across an audio frequency and where the first speaker has a generally irregular frequency response across the audio frequency range, the method further comprising:

placing the first and second speakers in a listening environment;

delaying and equalizing the first audio signal being provided to the second speaker to improve a psychoacoustically perceived audio frequency response of the first speaker in the listening environment without changing the psychoacoustically perceived physical location of the first speaker in the listening environment.

23. The method of claim 21, further comprising:

placing the first and second speakers in a listening environment;

adjusting the delay and frequency equalization of the first audio signal being provided to the second speaker and the delay and frequency equalization of the second audio signal being provided to the second speaker to generate a virtual speaker sound that is psychoacoustically perceived by a listener in the listening environment at a location other than actual locations of the first and second speakers in the listening environment.

24. The method of claim 20, where the first and second speakers are located in a passenger cabin of a vehicle.

25. The method of claim 20, where generating the first compensated audio signal and the second compensated audio signal further comprises executing a respective level adjuster to adjust a global energy level of the first and second compensated audio signals.

26. The method of claim 25, where the first and second compensated audio signals are generated with series delay, frequency equalization, and energy adjustment to generate audible sound from the first and second speakers that is psychoacoustically perceived by a listener as being substantially equal in magnitude.

27. A non-transitory computer readable medium configured to store computer executable instructions, the computer executable instructions being executable by a processor, the non-transitory computer readable medium comprising:

instructions executable by the processor to receive a first audio signal;

instructions executable by the processor to generate a first compensated audio signal from the first audio signal by execution of a series delay module and a frequency equalization module;

instructions executable by the processor to receive a second audio signal;

instructions executable by the processor to generate a second compensated audio signal from the second audio signal by execution of a series delay module and a frequency equalization module;

instructions executable by the processor to generate a first output signal for provision to a first speaker by summation of the first audio signal and the second compensated audio signal;

instructions executable by the processor to generate a second output signal for provision to a second speaker by summation of the second audio signal and the first compensated audio signal;

instructions executable by the processor to drive the first speaker to generate a first speaker output based on the first output signal, the first speaker output comprising a first audio signal output part and a second compensated audio signal output part;

instructions executable by the processor to drive the second speaker to generate a second speaker output based on the second output signal, the second speaker output comprising a second audio signal output part and a first compensated audio signal output part; and instructions executable by the processor to minimize degradation of perceived sound at a listening position, without changes in a psychoacoustically perceived physical location of the first speaker, by constructive combination of the first audio signal output part of the first speaker output and the first compensated audio signal output part of the second speaker output at the listening position, where the first compensated audio signal arrives at a predetermined delay after an arrival of the first audible sound and is psychoacoustically perceived at the listening position as arriving with the first audible sound.

* * * * *